US010773513B2

(12) United States Patent
Chalker

(10) Patent No.: US 10,773,513 B2
(45) Date of Patent: Sep. 15, 2020

(54) END DEFLECTORS FOR PRINTING BLADES

(71) Applicant: ASM Assembly Systems Singapore Pte. Ltd., Singapore (SG)

(72) Inventor: Ashley Roy Chalker, Weymouth (GB)

(73) Assignee: ASM ASSEMBLY SYSEMS SINGAPORE PTE. LTD., Singapore (SG)

( * ) Notice: Subject to any disclaimer, the term of this patent is extended or adjusted under 35 U.S.C. 154(b) by 357 days.

(21) Appl. No.: 15/601,028

(22) Filed: May 22, 2017

(65) Prior Publication Data

US 2017/0361601 A1 Dec. 21, 2017

(30) Foreign Application Priority Data

Jun. 17, 2016 (GB) ..... 1610668.4

(51) Int. Cl.

| | |
|---|---|
| ***B41F 15/40*** | (2006.01) |
| ***B41F 15/08*** | (2006.01) |
| ***B41F 15/46*** | (2006.01) |
| ***B41F 15/44*** | (2006.01) |
| ***B41F 15/42*** | (2006.01) |
| *B05C 17/06* | (2006.01) |
| *B41F 15/26* | (2006.01) |

(52) U.S. Cl.

CPC ..... *B41F 15/46* (2013.01); *B41F 15/42* (2013.01); *B41F 15/44* (2013.01); *B05C 17/06* (2013.01); *B41F 15/08* (2013.01); *B41F 15/0818* (2013.01); *B41F 15/26* (2013.01); *B41P 2215/50* (2013.01)

(58) Field of Classification Search

CPC .... B41F 15/08; B41F 15/085; B41F 15/0818; B41F 15/26; B41F 15/40; B41F 15/42; B41F 15/44; B41F 15/46; B05C 17/06; B05C 11/047

USPC ..... 101/123

See application file for complete search history.

(56) References Cited

U.S. PATENT DOCUMENTS

| | | | | |
|---|---|---|---|---|
| 6,142,070 | A | 11/2000 | Hoffman, Jr. et al. | 101/123 |
| 9,352,409 | B2 | 5/2016 | Kuroda et al. | |
| 2013/0239829 | A1 | 9/2013 | Kobayashi et al. | 101/123 |
| 2014/0182464 | A1 | 7/2014 | Zhang | 101/123 |
| 2015/0129640 | A1* | 5/2015 | Kuroda | B23K 3/0638 228/41 |
| 2015/0336377 | A1 | 11/2015 | Sueyasu et al. | |

FOREIGN PATENT DOCUMENTS

| | | | |
|---|---|---|---|
| CN | 202053666 | U | 11/2011 |
| CN | 202608228 | U | 12/2012 |
| CN | 204451491 | U | 7/2015 |
| GB | 2512038 | A | 9/2014 |
| JP | H04-189142 | A | 7/1992 |
| JP | H05-16326 | A | 1/1993 |
| JP | 3019617 | B2 | 3/2000 |
| JP | 2004-034638 | A | 2/2004 |
| JP | 2006-248170 | A | 9/2006 |

(Continued)

*Primary Examiner* — Leslie J Evanisko

(74) *Attorney, Agent, or Firm* — Ostrolenk Faber LLP

(57) ABSTRACT

Deflector units for use with a printing blade in printing a print medium through a printing screen, which are self-adjustable in a vertical direction for controlling production of rolls of print medium.

11 Claims, 9 Drawing Sheets

(56) References Cited

FOREIGN PATENT DOCUMENTS

| | | | |
|---|---|---|---|
| JP | 2013-123891 | A | 6/2013 |
| KR | 10-2012-0035082 | A | 4/2012 |
| TW | 201427511 | A | 7/2014 |

* cited by examiner

END DEFLECTORS FOR PRINTING BLADES

The present invention relates to deflectors for printing blades, typically squeegee blades, in preventing the escape of print medium beyond the lateral ends of printing blades in a printing operation, deflector units comprising such deflectors and printing heads comprising such deflector units.

BACKGROUND AND PRIOR ART

Various deflectors, sometimes referred to as end deflectors, are available, such as disclosed in GB-A-2512038, US-A-2015/0336377 and U.S. Pat. No. 9,352,409.

The present inventor has recognized that existing end deflectors suffer from a number of drawbacks, in causing disruption of the print medium roll at the lateral ends of the printing blade, and also in causing coining of the printing screen, where the end deflectors dig into the printing screen with repeated operation.

It is an aim of the present invention to provide improved end deflectors for printing blades, typically squeegee blades, in preventing the escape of print medium beyond the lateral ends of printing blades in a printing operation.

It is also an aim to enable simplified deflector switching methods for different print media, such as printing paste and adhesive.

It is a yet further aim to provide a deflector which is resistant to damage from paste contamination.

SUMMARY OF THE INVENTION

In one aspect the present invention provides a deflector unit for use with a printing blade in printing a print medium through a printing screen, the deflector unit comprising:

a body which is disposable adjacent a respective one of the ends of a printing blade;

a deflector which is movably disposed to the body for a range of travel along a first axis and acts to contain print medium within a lateral extent of the printing blade; and a biasing element which acts to bias the deflector from the body along the first axis;

wherein the biasing element is wholly enclosed within the body throughout the range of travel of the deflector.

Advantageously, the deflector includes a deflector member, which engages a surface of the printing screen in a printing operation.

In another aspect the present invention provides a deflector for use with a printing blade during a printing operation of printing a print medium through a printing screen to contain print medium within a lateral extent of the printing blade, wherein the deflector includes a deflector member, which has a first, engagement surface which engages a surface of the printing screen, a second, inwardly-facing surface which extends from the engagement surface and flares or tapers laterally outwardly in a first direction of printing, and a third, downwardly-facing surface which joins the second surface at a junction which is spaced at a distance from the first surface.

Preferably, the first surface extends over a substantially flat plane.

The second surface may extend over a substantially flat plane, or alternatively the second surface may be a curved or arcuate surface.

The second surface may have a first, rear edge and a second, forward edge, and a chord between the edges which encloses an angle (β) of less than about 45 degrees with the first direction of printing, optionally less than 40 degrees, optionally less than 35 degrees.

Preferably, the angle (β) may be greater than 20 degrees, optionally greater than 25 degrees, optionally greater than 30 degrees.

The second surface may extend substantially parallel to the first axis, optionally in a substantially vertical direction in use.

Preferably, the distance between the first and third surfaces is at least 5 mm.

Preferably, the distance between the first and third surfaces is at most 20 mm, optionally at most 15 mm, optionally at most 10 mm.

Preferably, the junction of the second and third surfaces encloses an angle of less than 110 degrees, optionally an angle of less than 100 degrees, optionally an angle of about 90 degrees.

The third surface may extend over a substantially flat plane. Alternatively, the third surface may be an arcuate or curved surface.

In a further aspect the present invention provides a deflector for use with a printing blade in printing a print medium through a printing screen to contain print medium within a lateral extent of the printing blade, wherein the deflector includes a deflector member which includes an elongate projection or recess, which is inclined substantially in parallel relation to the lateral edge of the printing blade and acts to reduce a pressure of the print medium at the junction of the deflector member and the printing blade in use.

The present invention also extends to a printing head, comprising: a support to which a printing blade is attachable; and first and second deflector units or deflectors as above described which are disposed adjacent respective ones of the lateral ends of the printing blade.

In one embodiment the deflector units are separable from the support.

In another embodiment the support and the deflector units are integrally formed.

BRIEF DESCRIPTION OF THE DRAWINGS

Preferred embodiments of the present invention will now be described hereinbelow by way of example only with reference to the accompanying drawings, in which.

DETAILED DESCRIPTION OF THE PREFERRED EMBODIMENTS OF THE INVENTION

Figure 1:
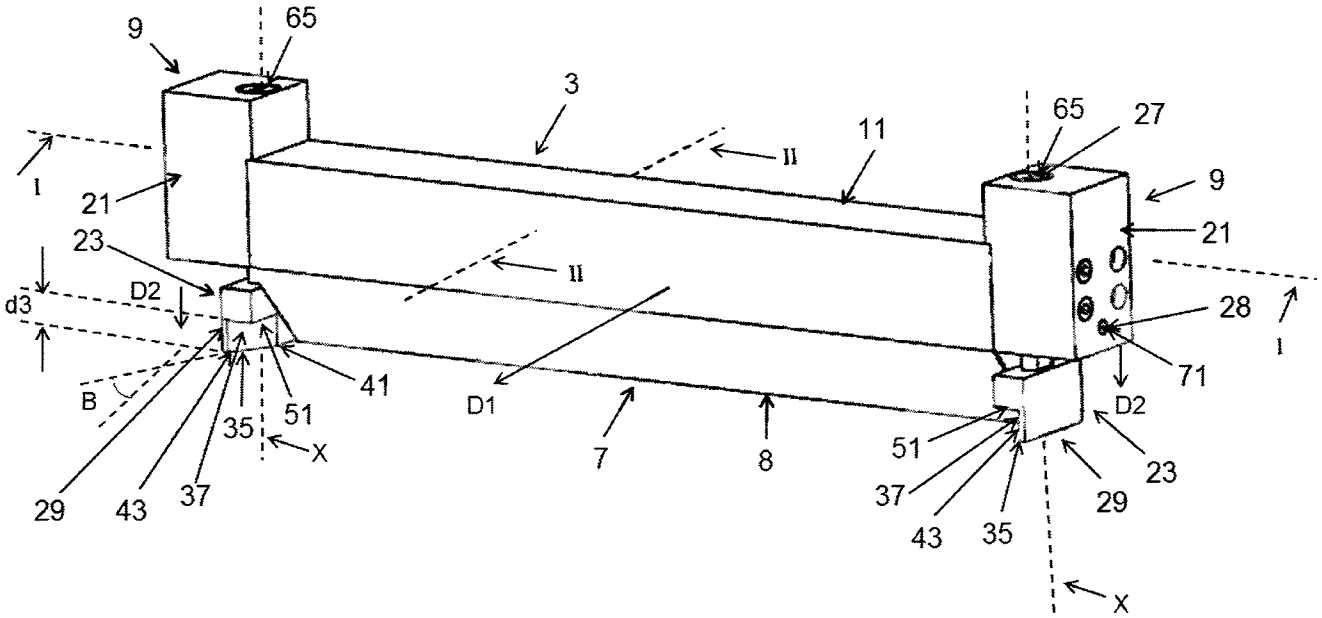
FIG. 1 illustrates a perspective view of a printing head in accordance with one embodiment of the present invention.
Figure 2:
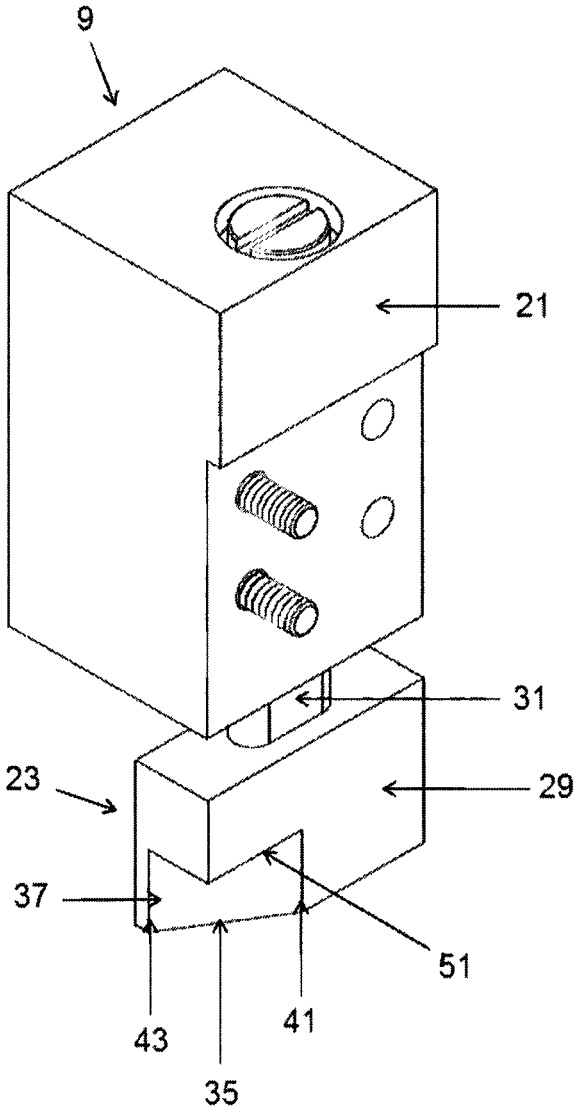
FIG. 2 illustrates a perspective view of one end deflector unit of the printing head of FIG. 1.
Figure 3:
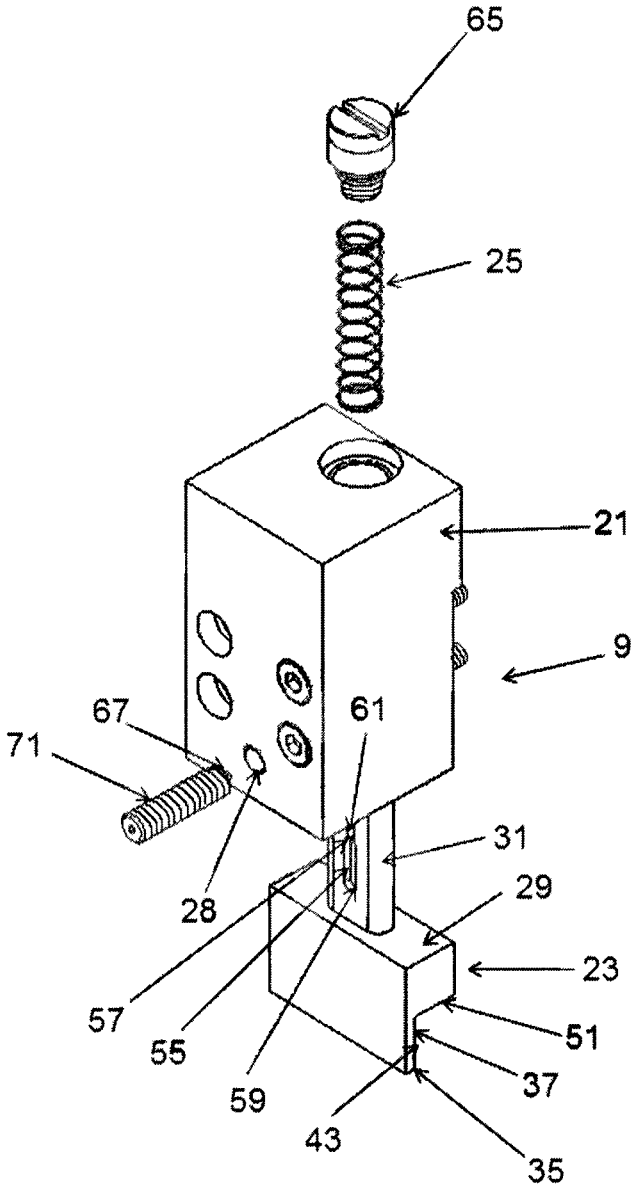
FIG. 3 illustrates an exploded perspective view of the end deflector unit of FIG. 2.
Figure 4:
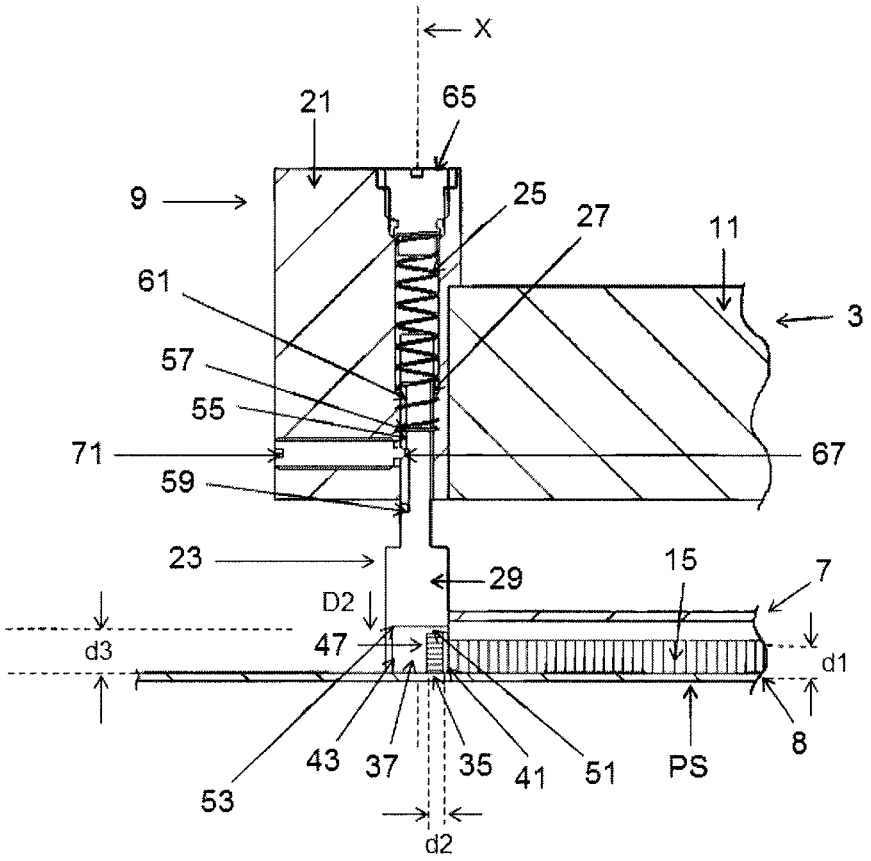
FIG. 4 illustrates a fragmentary part-sectional view (along section I-I in FIG. 1) of the printing head of FIG. 1, in a printing operation.
Figure 5:
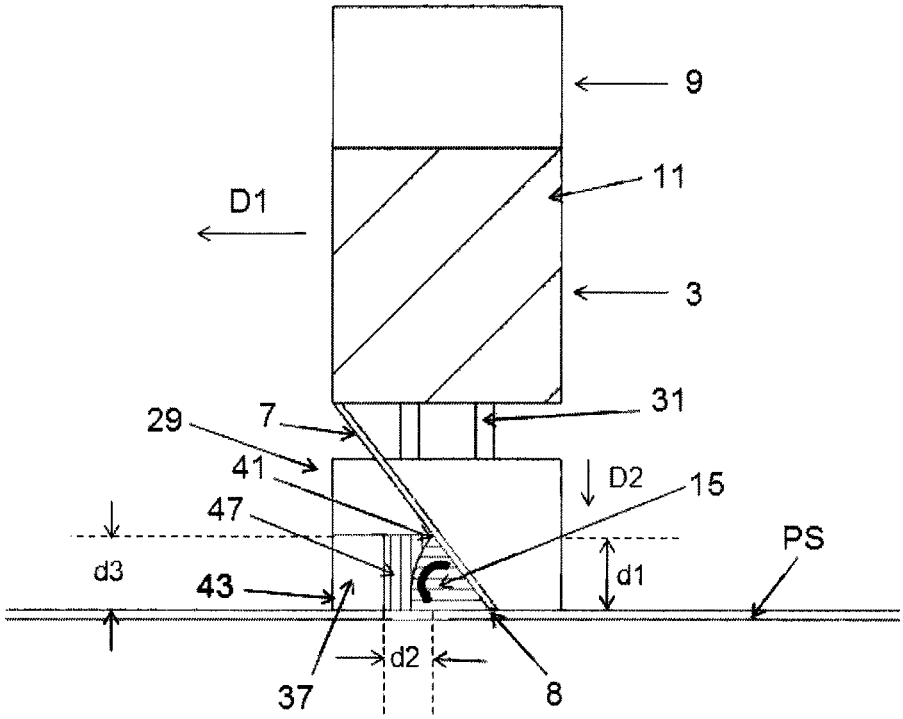
FIG. 5 illustrates a fragmentary part-sectional view (along section II-II in FIG. 1) of the printing head of FIG. 1, in a printing operation.

The printing head comprises a support 3, which is attached to a screen printing machine (not illustrated), a printing blade 7 which is attached to the support 3, and first and second end deflector units 9, which are attached to opposite ends of the support 3 to prevent print medium passing laterally beyond the respective ends of the printing blade 7 during a printing operation.

In this embodiment the print medium is a paste, such as a solder paste.

In this embodiment the support 3 comprises an elongate member 11 to which the printing blade 7 is attached.

In this embodiment the printing blade 7 has a first, lower edge 8 which contacts a printing screen PS in a printing operation, and the printing blade 7 depends downwardly from the support 3 to engage the printing screen PS, with a forwardly-inclined relation so as to create a main roll 15 of print medium, having an effective diameter of approximately d1, forwardly of the printing blade 7 in a direction of printing D1, at the junction of the printing blade 7 and the printing screen PS.

In this embodiment the printing blade 7 comprises a squeegee blade.

In this embodiment the end deflector units 9 each comprise a body 21 which is attached to a respective one of the ends of the support 3, a deflector 23 which is movably disposed to the body 21 for a range of travel along a first, substantially vertical axis X and is disposed adjacent a respective one of the ends of the printing blade 7 so as to contain the print medium within the lateral extent of the printing blade 7, and a biasing element 25 which acts to bias the deflector 23 in a downward direction D2 along the first axis X.

In this embodiment the biasing element 25 is a compression spring.

In this configuration, with the deflector 23 being movably coupled to the support 3, different pressures, which are applied to the printing blade 7 in various printing operations, can be accommodated, thereby providing that the deflectors 23 are self-adjusting and avoiding coining of the printing screen PS.

In this embodiment the body 21 includes a guide channel 27, here an elongate bore, which receives a counterpart guide member 31 of the deflector 23, as will be described in more detail hereinbelow. The guide channel 27 comprises two sections, a first, lower section in which the guide member 31 is accommodated, and a second, upper section in which the biasing element 25 is accommodated. The lower section is preferably of non-circular cross-section, which acts to prevent rotation of the guide member 31, and hence deflector 23, relative to the body 21. The upper section is preferably of circular cross-section, for accommodating and allowing compression and extension of the compression spring biasing element 25. It will be noted that this difference in cross-sections prevents the biasing element 25 from falling out of the body 21 if the deflector 23 is removed therefrom. The two sections are aligned and connected, such that the distal end of the guide member 31, i.e. that end which extends furthest into guide channel 27, contacts the biasing element 25 and is thereby biased in a downward direction. In this way the deflector 23 is biased towards the printing screen in use.

In this embodiment the biasing element 25 is held captive by a fixing 65, here a screw fixing, which completely closes the upper section end of guide channel 27.

In this embodiment the body 21 includes a lateral bore 28, arranged generally orthogonally to the length of the guide channel 27 and in communication therewith, for receiving an engagement member 71, as will be described in more detail hereinbelow.

In this embodiment the deflector 23 includes a deflector member 29 which engages a surface of the printing screen PS in a printing operation, and a guide member 31, here an elongate shaft, which is counterpart to the guide channel 27 and is slidingly-disposed within the guide channel 27, such that the deflector 23 is constrained to move along the first axis X in relation to the body 21 along its range of travel. The cross-sectional shape and dimension of the guide member 31 conforms closely to that of the guide channel 27, which prevents paste or adhesive from entering the guide channel 27, thus preventing contamination.

In this embodiment the deflector member 29 has a first, engagement surface 35 which engages the printing screen PS in a printing operation, and a second, inwardly-facing surface 37 which extends from the engagement surface 35 and flares or tapers laterally outwardly in the direction of printing D1.

In this embodiment the first surface 35 is a substantially planar surface.

In this embodiment the first surface 35 is profiled or textured, in the manner of tyre tracks, which promotes the transfer of any print medium at the first surface 35 laterally inwardly towards the printing blade 7.

In this embodiment the second surface 37 is a substantially planar surface.

In another embodiment the second surface 37 could be a curved or arcuate surface.

In this embodiment the second surface 37 has a first, rear edge 41 and a second, forward edge 43, and a chord between the edges 41, 43 encloses an angle β of less than 45 degrees with the direction of printing D1.

In this embodiment the angle β is 32 degrees.

In one embodiment the angle β is less than 45 degrees.

In another embodiment the angle β is less than 40 degrees.

In a further embodiment the angle β is less than 35 degrees.

In one embodiment the angle β is at least 20 degrees.

In another embodiment the angle β is at least 25 degrees.

In a further embodiment the angle β is at least 30 degrees.

In this embodiment the second surface 37 extends substantially perpendicular to the contact edge 8 of the printing blade 7, here substantially parallel to the first axis X, in a substantially-vertical direction.

With this configuration, second, subsidiary rolls 47 of the print medium are developed at the respective deflectors 23, having an effective diameter of approximately d2, smaller than diameter d1, which act to return the print medium which passes outwardly of the respective ends of the printing blade 7 back into the main roll 15 of print medium with little disturbance to the uniformity of the main roll 15 of print medium.

In this embodiment the deflector member 29 includes a third, downwardly-facing surface 51 which joins the second surface 37 at a distance d3 from the lower surface 35 thereof.

In this embodiment the distance d3 is 8 mm.

In one embodiment the distance d3 is at least 5 mm.

In one embodiment the distance d3 is at most 20 mm.

In one embodiment the distance d3 is at most 15 mm.

In one embodiment the distance d3 is at most 10 mm.

In this embodiment the junction of the second and third surfaces 37, 51 is a substantially square junction.

In this embodiment the junction of the second and third surfaces 37, 51 encloses an angle of about 90 degrees.

In another embodiment the junction of the second and third surfaces 37, 51 encloses an angle of less than 110 degrees.

In a further embodiment the junction of the second and third surfaces 37, 51 encloses an angle of less than 100 degrees.

In this embodiment the third surface 51 extends is a substantially flat surface.

In this embodiment the third surface 51 extends in substantially perpendicular relation to the second surface 37.

In an alternative embodiment the third surface 51 could be an arcuate or curved surface.

The third surface 51 acts to prevent upward movement of the paste in use. This helps to prevent paste from entering the guide channel 27 at its lower end. Furthermore, the combination of third surface 51 and the angled second surface 37 acts to constrain the paste to create the rolls 47, having a height approximately equal to d3, during the printing operation. This constrains the paste, reducing wastage and simplifying re-use.

In this embodiment the guide member 31 includes a recess 55, here an elongate slot which extends axially along the guide member 31, which defines first and second limit stops 57, 59. Each body 21 of respective end deflector units 9 further comprises a detent 67, which extends into the recess 55 in the guide member 31 to define the limit of travel of the deflector 23 along the first axis X by engagement with the limit stops 57, 59 of the recess 55.

In this embodiment, the detent 67 is provided by an engagement member 71, which is disposed in the bore 28 in the body 21.

In this embodiment the engagement member 71 takes the form of a screw, which is threadedly engaged in the bore 28 and completely closes the same. This arrangement allows the position of the detent 67 with respect to the body 21 and recess 55 to be adjusted by rotation of the engagement member 71 within the bore 28, whereby the detent 67 may be adjusted to provide sufficient engagement with the end stops 57, 59 to delimit the travel of the deflector 23 along the first axis X, such that the detent 67 is captively located within the recess 55.

In this embodiment the guide member 31 includes a groove 61 which extends axially along the guide member 31 from the recess 55 to the distal end thereof, that is the end opposite to the deflector member 29.

In this embodiment the groove 61 is a V-shaped groove.

By suitable adjustment of detent 67 by rotation of the engagement member 71, the detent 67 can be drawn out of the recess 55 by manual application by an operator and along the groove 61, against the frictional resistance with the groove 61.

In this way, the groove 61 allows the deflector 23 to be fitted to and removed from the body 21 without requiring any tools, with the groove 61 being shaped and/or sized to allow an operator manually to overcome the frictional resistance with the detent 67. With this configuration, an operator can readily change the deflectors 23, such as for cleaning or replacement. This design also enables different types of deflector to be fitted in a modular fashion, for example to interchange between deflectors more suitable for paste application and deflectors more suitable for adhesive application, or to allow separate deflectors for leaded and lead-free paste. Furthermore, the inclusion of groove 61 on only one side of the guide member 31 prevents the guide member being inserted by an operator into the body 21 in an incorrect orientation.

It will be apparent that with the above-described configuration, the biasing element 25 is located internally of, and wholly enclosed within, the body 21, throughout the deflector's range of travel, and that paste or adhesive, or indeed any other potential contaminant, is prevented from contaminating the biasing element 25. In particular, no paste may enter the guide channel 27 at its lower opening due to the close conformance of the first section's cross-section with the cross-section of the guide member 31 and the barrier effect provided by third surface 51, no paste may enter the guide channel 27 at its upper opening due to the closure by fixing 65, and no paste may enter the guide channel 27 via lateral bore 28 due to the closure by engagement member 71.

Figure 6:
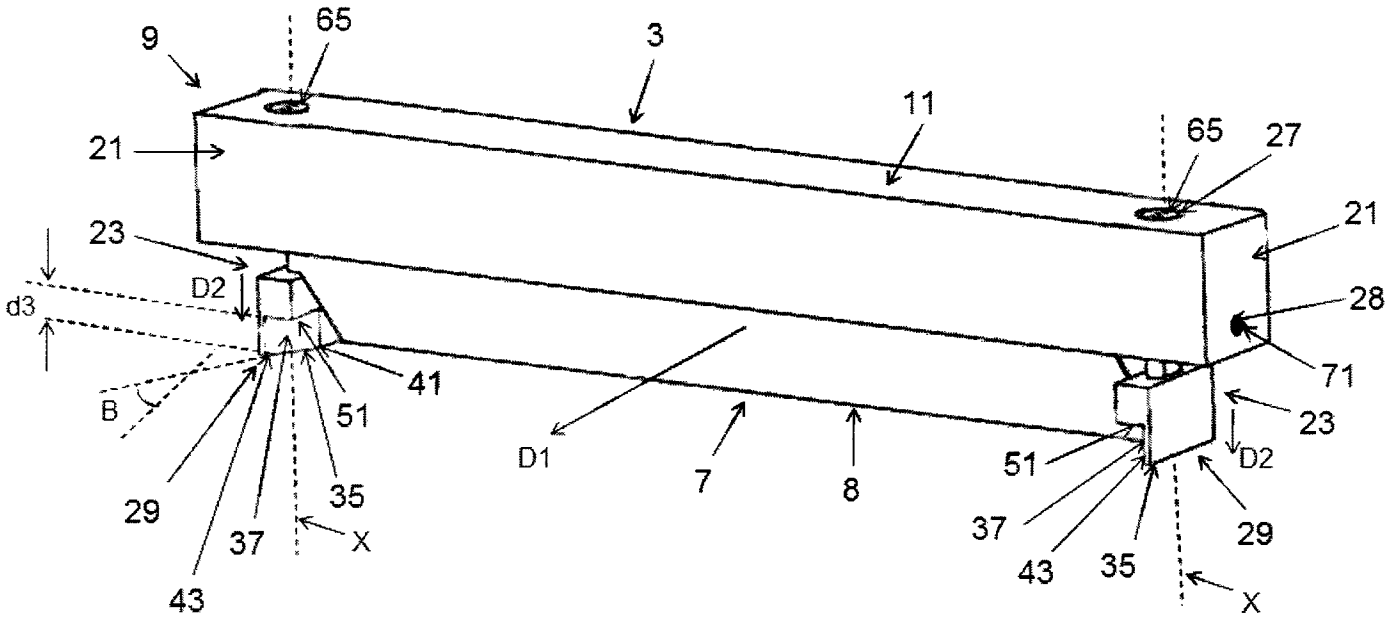
FIG. 6 illustrates a printing head in accordance with another embodiment of the present invention.

FIG. 6 illustrates a printing head in accordance with another embodiment of the present invention.

The printing head of this embodiment is very similar to that of the above-described embodiment, and thus, in order to avoid unnecessary duplication of description, only the differences will be described in detail, with like parts being designated by like reference signs.

The printing head of this embodiment differs from that of the above-described embodiment in that the support 3, the printing blade 7 and the end deflectors 9 are formed as an integral unit.

Figure 7:
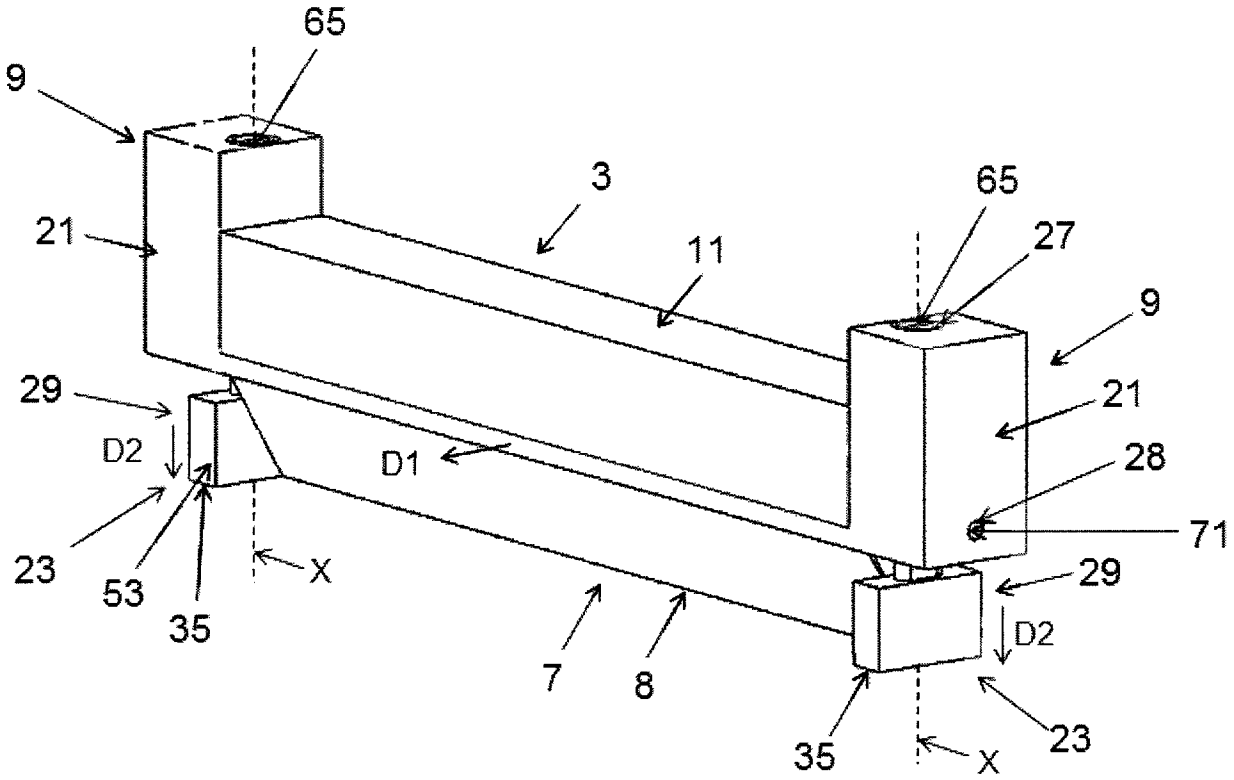
FIG. 7 illustrates a printing head in accordance with a further embodiment of the present invention.

FIG. 7 illustrates a printing head in accordance with a further embodiment of the present invention.

The printing head of this embodiment is quite similar to that of the first-described embodiment, and thus, in order to avoid unnecessary duplication of description, only the differences will be described in detail, with like parts being designated by like reference signs.

The printing head of this embodiment differs in that the deflector members 29 omit the second and third surfaces 37, 51.

Although the omission of the second and third surfaces 37, 51 from the deflector members 29 does not allow for the formation of the subsidiary rolls 47 of the print medium at the lateral ends of the main roll 15 of the print medium, the deflector members 29 still advantageously are self-adjusting, independent of the pressure as applied to the printing blade 7, thereby preventing coining of the printing screen PS.

This embodiment has particular application to print medium in the form of glues and inks.

Finally, it will be understood that the present invention has been described in its preferred embodiments and can be modified in many different ways without departing from the invention as defined by the scope of the appended claims.

Figure 8:
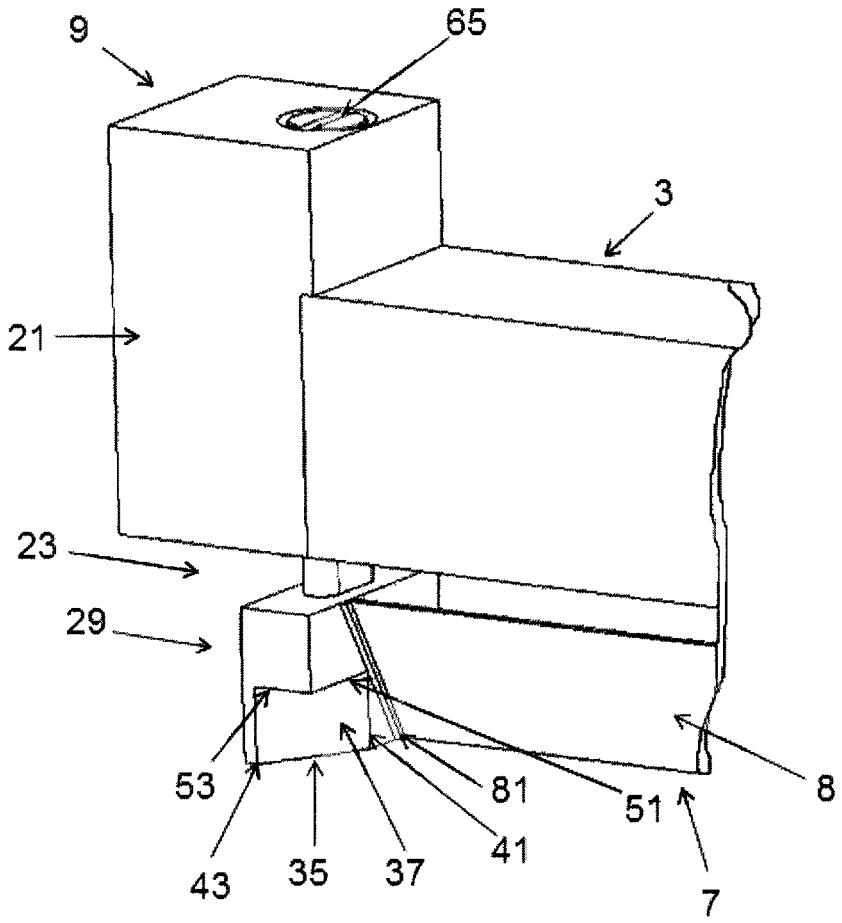
FIG. 8 illustrates a modified deflector for the printing heads of FIGS. 1 and 6.

For example, in one embodiment, as illustrated in FIG. 8, the deflector member 29 could include a raised, elongate projection 81, which is inclined substantially in parallel relation to the printing blade 7, and acts to reduce the pressure of the print medium at the junction of the second surface 37 and the printing blade 7. This helps to reduce the formation of "snail trails", i.e. thin trails of paste left in the wake of the printing blade 7 during the printing operation.

In this embodiment the projection 81 has the form of a ridge or bead, optionally a rounded ridge or bead.

Although illustrated in relation to the deflectors 23 of FIGS. 1 and 6, the projection 81 could have equal application to the embodiment of FIG. 7.

Figure 9:
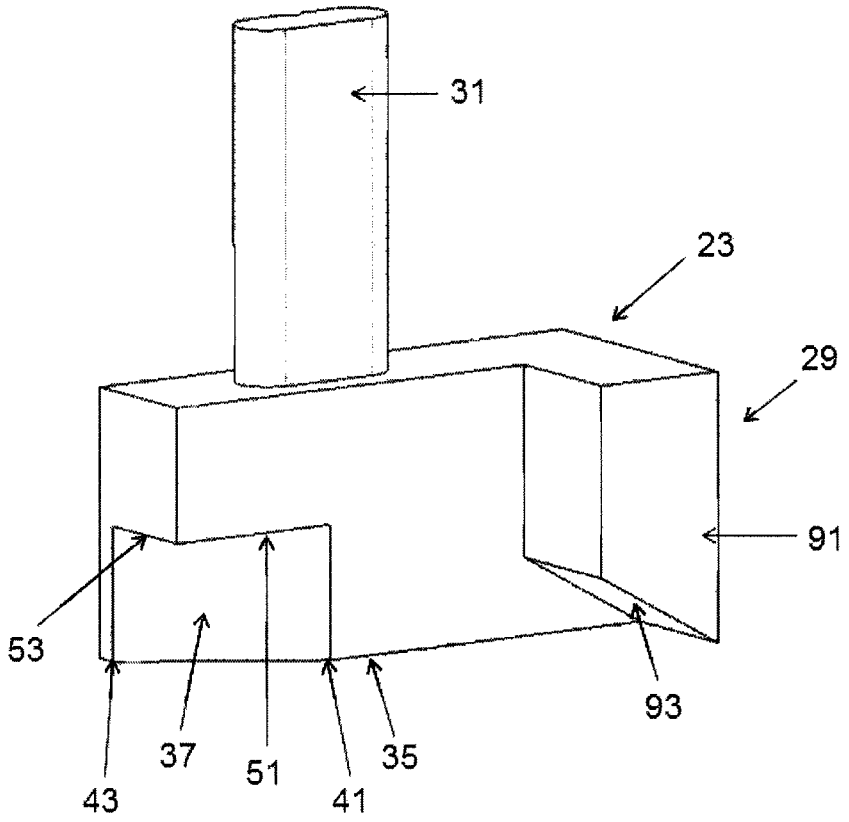
FIG. 9 illustrates another modified deflector for the printing heads of FIGS. 1 and 6.

For example, in another embodiment, as illustrated in FIG. 9, the deflector 23 could include an inwardly-projecting member 91 at a rear, trailing edge in the direction of printing D1, which is located rearwardly of the printing blade 7 and includes a surface 93 which acts to transfer any print medium which remains on the printing screen PS after traversal of the print head 3 laterally inwardly into the printing region of the printing screen PS. This also helps to reduce the formation of "snail trails".

Although illustrated in relation to the deflectors 23 of FIGS. 1 and 6, the inwardly-projecting member 91 could have equal application to the embodiment of FIG. 7.

The invention claimed is:

1. A deflector unit for use with a printing blade in printing a print medium through a printing screen, the deflector unit comprising:

a body which is disposable adjacent a respective one of the ends of a printing blade;

a deflector which is movably disposed to the body for a range of travel along a first axis and acts to contain print medium within a lateral extent of the printing blade; and a biasing element which acts to bias the deflector from the body along the first axis;

wherein the biasing element is wholly enclosed within the body throughout the range of travel of the deflector; and wherein the deflector includes a guide member having a cross-sectional shape and dimension, and the body includes a guide channel in which the guide member is slidingly disposed, such that the deflector is constrained to move along the first axis in relation to the body, the guide channel having a cross-sectional shape and dimension which conforms to that of the guide member to prevent contamination of the biasing element by the print medium in use.

2. The deflector unit of claim 1, wherein the guide member comprises an elongate shaft and the guide channel comprises an elongate bore.

3. The deflector unit of claim 1, wherein the biasing element engages a distal end of the guide member.

4. The deflector unit of claim 1, wherein the biasing element comprises a compression spring.

5. The deflector unit of claim 1, wherein the guide member includes a recess.

6. The deflector unit of claim 5, wherein the guide member includes a groove which extends substantially axially along the guide member from the recess to a distal end thereof.

7. The deflector unit of claim 5, wherein the recess comprises an elongate slot extending axially along the guide member, which defines first and second limit stops, and the body includes a detent which is located captively within the recess, whereby the limit stops define a limit of travel of the deflector along the first axis.

8. The deflector unit of claim 6, wherein the groove is a V-shaped groove, wherein the groove allows the deflector to be fitted to and removed from the body without requiring any tools, with the groove being shaped and/or sized to allow an operator manually to overcome frictional resistance with a detent located within the recess.

9. The deflector unit of claim 1, comprising the deflector for use with a printing blade during a printing operation of printing a print medium through a printing screen to contain print medium within a lateral extent of the printing blade, wherein the deflector includes a deflector member, which has a first, engagement surface which engages a surface of the printing screen, a second, inwardly-facing surface which extends from the engagement surface and flares or tapers laterally outwardly in a first direction of printing, and a third, downwardly-facing surface which joins the second surface at a junction which is spaced at a distance from the first surface.

10. The deflector unit of claim 1, comprising a deflector for use with a printing blade in printing a print medium through a printing screen to contain print medium within a lateral extent of the printing blade, wherein the deflector includes a deflector member which includes an elongate projection or recess, which is inclined substantially in parallel relation to the lateral edge of the printing blade and acts to reduce a pressure of the print medium at the junction of the deflector member and the printing blade in use.

11. A printing head, comprising:

a support to which a printing blade is attachable; and first and second deflector units of claim 1 which are disposed adjacent respective ones of the lateral ends of the printing blade.

* * * * *